US009259034B2

(12) United States Patent
Holford et al.

(10) Patent No.: US 9,259,034 B2
(45) Date of Patent: Feb. 16, 2016

(54) PACK FOR SMOKING ARTICLES

(71) Applicants: BRITISH AMERICAN TOBACCO (INVESTMENTS) LIMITED, London (GB); BRITISH AMERICAN TOBACCO JAPAN, LIMITED, Tokyo (JP)

(72) Inventors: Steven Holford, London (GB); Aaron McKenzie, London (GB); Mike Simpson, Tokyo (JP)

(73) Assignees: BRITISH AMERICAN TOBACCO (INVESTMENTS) LIMITED (GB); BRITISH AMERICAN TOBACCO JAPAN, LIMITED (JP)

( * ) Notice: Subject to any disclaimer, the term of this patent is extended or adjusted under 35 U.S.C. 154(b) by 0 days.

(21) Appl. No.: 14/374,890

(22) PCT Filed: Dec. 17, 2012

(86) PCT No.: PCT/EP2012/075795

§ 371 (c)(1),
(2) Date: Jul. 25, 2014

(87) PCT Pub. No.: WO2013/110411

PCT Pub. Date: Aug. 1, 2013

(65) Prior Publication Data

US 2014/0374287 A1 Dec. 25, 2014

(30) Foreign Application Priority Data

Jan. 25, 2012 (GB) ..... 1201209.2

(51) Int. Cl.
*A24F 15/06* (2006.01)
*B65D 85/10* (2006.01)
(Continued)

(52) U.S. Cl.
CPC ..... *A24F 15/06* (2013.01); *A24F 15/00* (2013.01); *B65D 5/728* (2013.01); *B65D 85/1009* (2013.01); *B65D 85/1045* (2013.01)

(58) Field of Classification Search
CPC ..... B65D 85/10; B65D 85/1009; B65D 85/1036; B65D 85/1045; A45F 15/04; A45F 15/00; A45F 15/06; A45F 15/16
USPC ..... 206/249, 248, 252, 264, 270, 266, 273
See application file for complete search history.

(56) References Cited

U.S. PATENT DOCUMENTS 1,922,996 A 8/1933 Wester
3,439,797 A * 4/1969 Cooper et al. ..... 206/249
(Continued)

FOREIGN PATENT DOCUMENTS

CN 2481664 Y 3/2002
CN 1346780 A 5/2002
(Continued)

OTHER PUBLICATIONS

International Search Report, mailed Oct. 14, 2013 for International Patent Application No. PCT/EP2012/075795, filed Dec. 17, 2012.
(Continued)

*Primary Examiner* — Steven A. Reynolds
(74) *Attorney, Agent, or Firm* — Cantor Colburn LLP

(57) ABSTRACT

A pack for smoking articles including an outer housing (11) having an open end and an inner casing (12) telescopically received within the outer housing and moveable between an open position in which the inner casing (12) at least partially extends out of the open end of the outer housing (11), and a closed position in which the inner casing (12) is retracted further into the outer housing than in the open position. The inner casing (12) includes an elongate access aperture (29) configured to enable elongate smoking articles to be laterally dispensed therefrom in a direction transverse to their longitudinal axes.

13 Claims, 10 Drawing Sheets

(51) Int. Cl.
*B65D 5/72* (2006.01)
*A24F 15/00* (2006.01)

(56) References Cited

U.S. PATENT DOCUMENTS

| | | | | | |
|---|---|---|---|---|---|
| 4,267,958 | A | | 5/1981 | Focke et al. | |
| 4,534,463 | A | * | 8/1985 | Bouchard | 206/267 |
| 5,058,739 | A | * | 10/1991 | Sainsbury | 206/252 |
| 5,080,227 | A | * | 1/1992 | Focke | 206/273 |
| 5,682,986 | A | * | 11/1997 | Cobler | 206/265 |
| 5,738,207 | A | | 4/1998 | Trimani | |
| 6,450,329 | B1 | * | 9/2002 | Draghetti et al. | 206/252 |
| 6,719,131 | B1 | * | 4/2004 | Focke et al. | 206/268 |
| 8,567,598 | B2 | * | 10/2013 | Gibson | 206/268 |
| 2004/0256253 | A1 | | 12/2004 | Henson et al. | |
| 2005/0061689 | A1 | * | 3/2005 | Yin et al. | 206/261 |
| 2007/0278115 | A1 | * | 12/2007 | Ghini et al. | 206/248 |
| 2008/0149507 | A1 | * | 6/2008 | Rose et al. | 206/267 |
| 2008/0230410 | A1 | * | 9/2008 | Jones et al. | 206/268 |
| 2008/0289977 | A1 | * | 11/2008 | Ghini et al. | 206/256 |
| 2010/0176010 | A1 | * | 7/2010 | Tearle | 206/256 |
| 2011/0062037 | A1 | * | 3/2011 | Bertuzzi et al. | 206/267 |
| 2011/0147242 | A1 | * | 6/2011 | Superti | 206/250 |
| 2012/0211380 | A1 | * | 8/2012 | Ghini et al. | 206/245 |
| 2013/0264231 | A1 | * | 10/2013 | He | 206/249 |
| 2013/0270130 | A1 | * | 10/2013 | Ghini et al. | 206/242 |
| 2014/0238877 | A1 | * | 8/2014 | Petrucci et al. | 206/255 |

FOREIGN PATENT DOCUMENTS

| | | | |
|---|---|---|---|
| CN | 2496809 | Y | 6/2002 |
| CN | 2536535 | Y | 2/2003 |
| CN | 1456486 | A | 11/2003 |
| CN | 2587796 | Y | 11/2003 |
| CN | 2848755 | Y | 12/2006 |
| CN | 201010210 | Y | 1/2008 |
| CN | 201214536 | Y | 4/2009 |
| CN | 201258161 | Y | 6/2009 |
| EP | 0059915 | A1 | 9/1982 |
| EP | 1790574 | A1 | 5/2007 |
| EP | 1950136 | A2 | 7/2008 |
| GB | 107331 | | 6/1917 |
| GB | 254199 | | 7/1926 |
| GB | 437180 | | 10/1935 |
| GB | 938547 | | 10/1963 |
| GB | 2011353 | A | 7/1979 |
| GB | 2295816 | A | 6/1996 |
| JP | 60184820 | | 12/1985 |
| JP | 2005329975 | | 12/2005 |
| WO | 2006017978 | A1 | 2/2006 |
| WO | 2006021581 | A1 | 3/2006 |
| WO | 2007128435 | A2 | 11/2007 |
| WO | 2008065038 | A1 | 6/2008 |
| WO | 2010011627 | A1 | 1/2010 |
| WO | 2010037529 | A1 | 4/2010 |
| WO | 2010058237 | A1 | 5/2010 |
| WO | 2010149375 | A1 | 12/2010 |
| WO | 2011138184 | A1 | 11/2011 |

OTHER PUBLICATIONS

Written Opinion, mailed Feb. 18, 2014 for International Patent Application No. PCT/EP2012/075795, filed Dec. 17, 2012.

International Preliminary Report on Patentability, mailed Apr. 17, 2014 for International Patent Application No. PCT/EP2012/075795, filed Dec. 17, 2012.

Office Action for Japanese Patent Application No. 2014-552545 dated Aug. 18, 2015 (English machine translation).

* cited by examiner

PACK FOR SMOKING ARTICLES

CLAIM FOR PRIORITY

This application is the National Stage of International Application No. PCT/EP2012/075795, filed Dec. 17, 2012, which in turn claims priority to and benefit of British Patent Application No. GB1201209.2, filed Jan. 25, 2012. The entire contents of the aforementioned applications are herein expressly incorporated by reference.

TECHNICAL FIELD

The present invention relates to a pack for smoking articles and, more particularly, but not exclusively, to a pack having an inner casing slidable within an outer housing.

BACKGROUND

Packs are known which comprise an outer housing and an inner casing slidably received within the outer housing and moveable between a closed position in which the inner casing is received within the outer housing, and an open position in which the inner casing at least partially extends out of the outer housing to enable a user to access smoking articles contained within the inner casing. Such packs are generally known as "shell and slide" packs.

SUMMARY

Embodiments of the invention provide a pack for smoking articles comprising an outer housing having an open end and an inner casing telescopically received within the outer housing and moveable between an open position in which the inner casing at least partially extends out of the open end of the outer housing, and a closed position in which the inner casing is retracted further into the outer housing than in the open position, wherein the inner casing includes an elongate access aperture configured to enable elongate smoking articles to be laterally dispensed therefrom in a direction transverse to their longitudinal axes.

The pack may be configured to contain elongate smoking articles oriented with their longitudinal axes perpendicular to the telescopic sliding direction of the inner casing relative to the outer housing.

The elongate access aperture may be configured with its longitudinal direction substantially perpendicular to the telescopic sliding direction of the inner casing relative to the outer housing. The elongate access aperture may be formed in a front wall of the inner casing or a top wall of the inner casing, and may extend around to side walls of the inner casing.

The inner casing may include a slot formed in an outer wall thereof configured to enable a user to manipulate smoking articles contained within the inner casing towards and out of the access aperture. The slot may be in communication with the elongate access aperture, and may extend substantially perpendicular to the longitudinal direction of the elongate access aperture.

The outer housing may include a slot formed in an outer wall thereof disposed corresponding to the slot formed in the inner casing.

The pack may further comprise a biasing element disposed between the outer housing and the inner casing configured to bias the inner casing out of the outer housing into the open position. The biasing element may comprise a folded card spring, and may be formed integrally with the outer housing and/or the inner casing. Alternatively, the biasing element may comprise a separate component which may be adhered to the outer housing and/or the inner casing. In a yet further alternative embodiment, the pack may comprise a "push-push" mechanism to alternately close and open the pack as the inner casing is pushed into the outer housing.

The pack may further comprise cooperating locking means configured to retain the inner casing in a closed position within the outer housing.

The inner casing may include a lid hingedly attached thereto and pivotable between an open position in which the access aperture is exposed and a closed position in which the lid covers the access aperture.

The locking means may comprise at least one first tab provided on the outer housing and a second tab provided on the lid, and one of the first and second tabs may be folded over and adhered to the respective wall of the outer housing/lid. The outer housing may include an inner frame and the at least one first tab may be formed on the inner frame. The outer housing may include a pair of first tabs spaced from each other, and the pair of first tabs may be disposed either side of the slot(s) in the inner casing and/or the outer housing. The or each first tab may be angled downwards towards the middle of the respective wall of the outer housing.

The access aperture may be provided with one or more smoking article retaining elements configured to prevent smoking articles within the inner casing freely falling out through the access aperture, and the retaining element(s) may comprise at least one resilient tab extending at least partially across the access aperture. The retaining element(s) may comprise at least one resilient tab formed integrally with, or adhere to, the inner casing. The at least one resilient tab may extend from one wall of the inner casing to an opposite wall of the inner casing across the access aperture and may include a line of weakening configured to be broken upon removal of the first smoking article from the inner casing.

The pack may further comprise a stop mechanism to prevent the inner casing extending out of the outer housing beyond a predetermined distance of a fully open position. The stop mechanism may comprise at least one first tab extending inwardly from the outer housing and at least one second tab projecting outwardly from the inner casing, the first and second tabs being configured to engage each other at the predetermined fully extended position of the inner casing to prevent further movement thereof in the opening direction.

In the closed position, the pack may have a longitudinal dimension and a shorter transverse dimension, and the inner casing may be telescopically slidable relative to the outer housing in a direction of the transverse dimension.

The inner casing may be entirely received within the outer housing when the pack is in the closed position.

The pack may further comprise a detachable panel covering the access aperture. The detachable panel may be formed integrally with the inner casing and delimited by a line of weakening, such as perforations in the material of the inner casing.

The outer housing may comprise major front and tear walls connected by minor side walls and a bottom wall, and have an open top end, and the inner casing may comprise major front and rear walls connected by minor side walls and a bottom wall, and may be moveable into and out of the outer housing through the open top end thereof, and the access aperture may be formed in a top end of the inner casing. Alternatively, the outer housing may comprise major front and rear walls connected by minor side walls and a bottom wall, and have an open top end, and the inner casing may comprise major front and rear walls connected by minor side walls, a top wall and a bottom wall, and may be moveable into and out of the outer housing through the open top end thereof, and the access aperture may be formed in the front wall of the inner casing.

The pack may contain elongate smoking articles with their longitudinal axes orientated parallel to the longitudinal direction of the access aperture.

BRIEF DESCRIPTION OF THE DRAWINGS

Preferred embodiments of the present invention will now be described, by way of example only, with reference to the accompanying drawings, in which.

DETAILED DESCRIPTION

Figure 1:
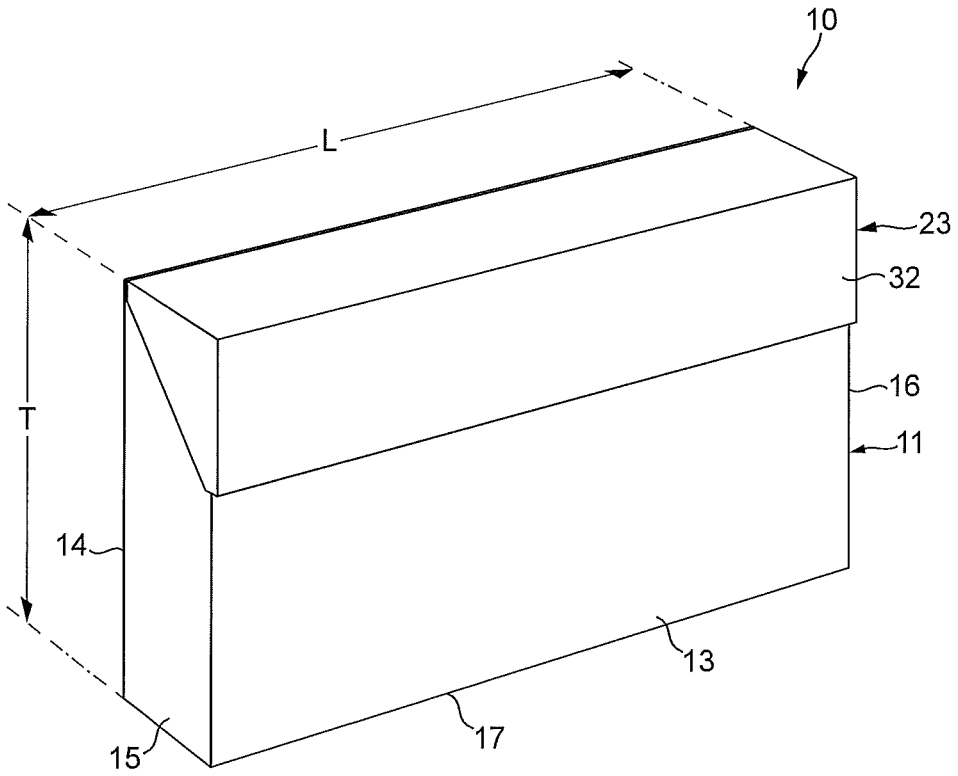
FIG. 1 shows a pack according to a first embodiment of the invention in a closed position.
Figure 2:
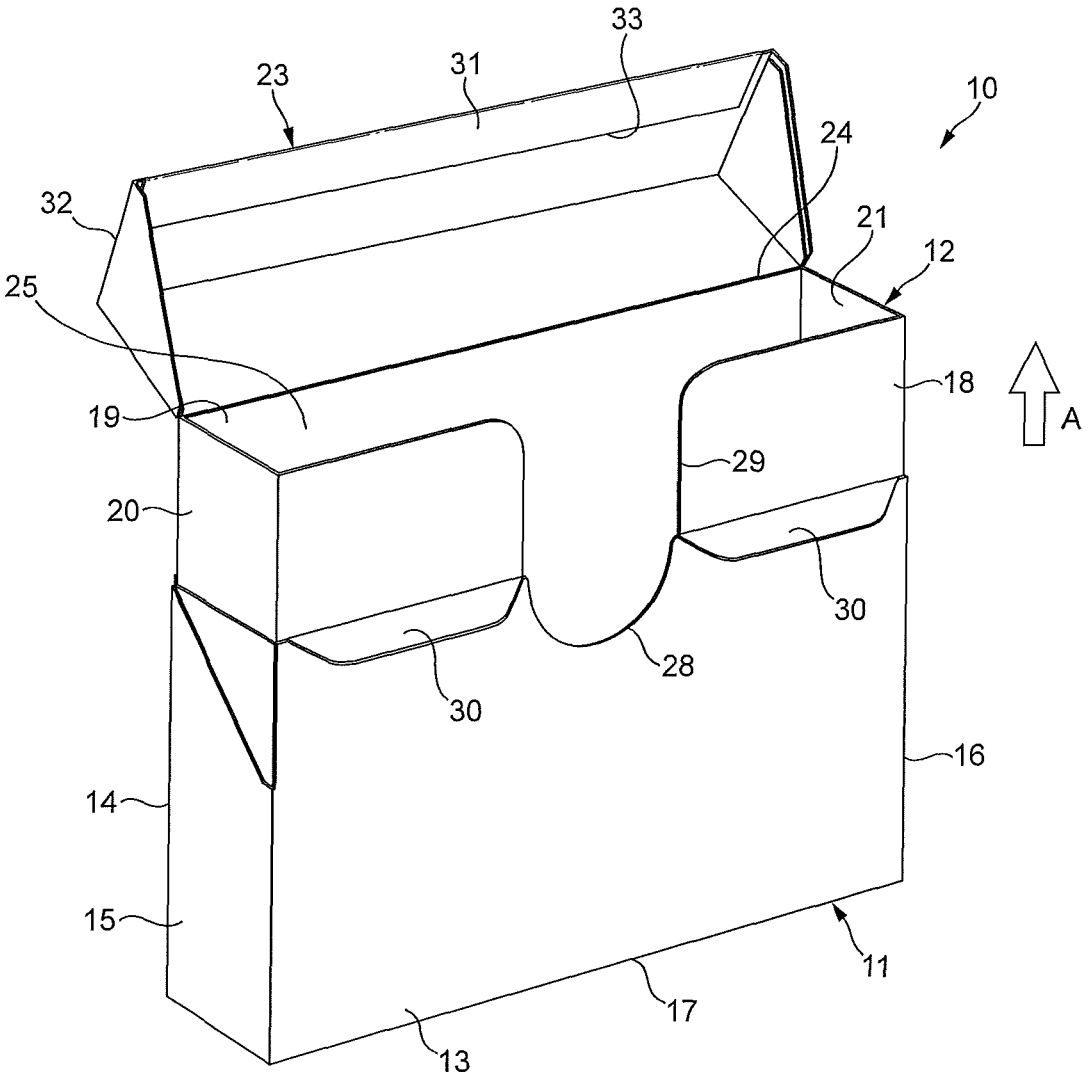
FIG. 2 shows the pack of FIG. 1 in an open position.
Figure 3:
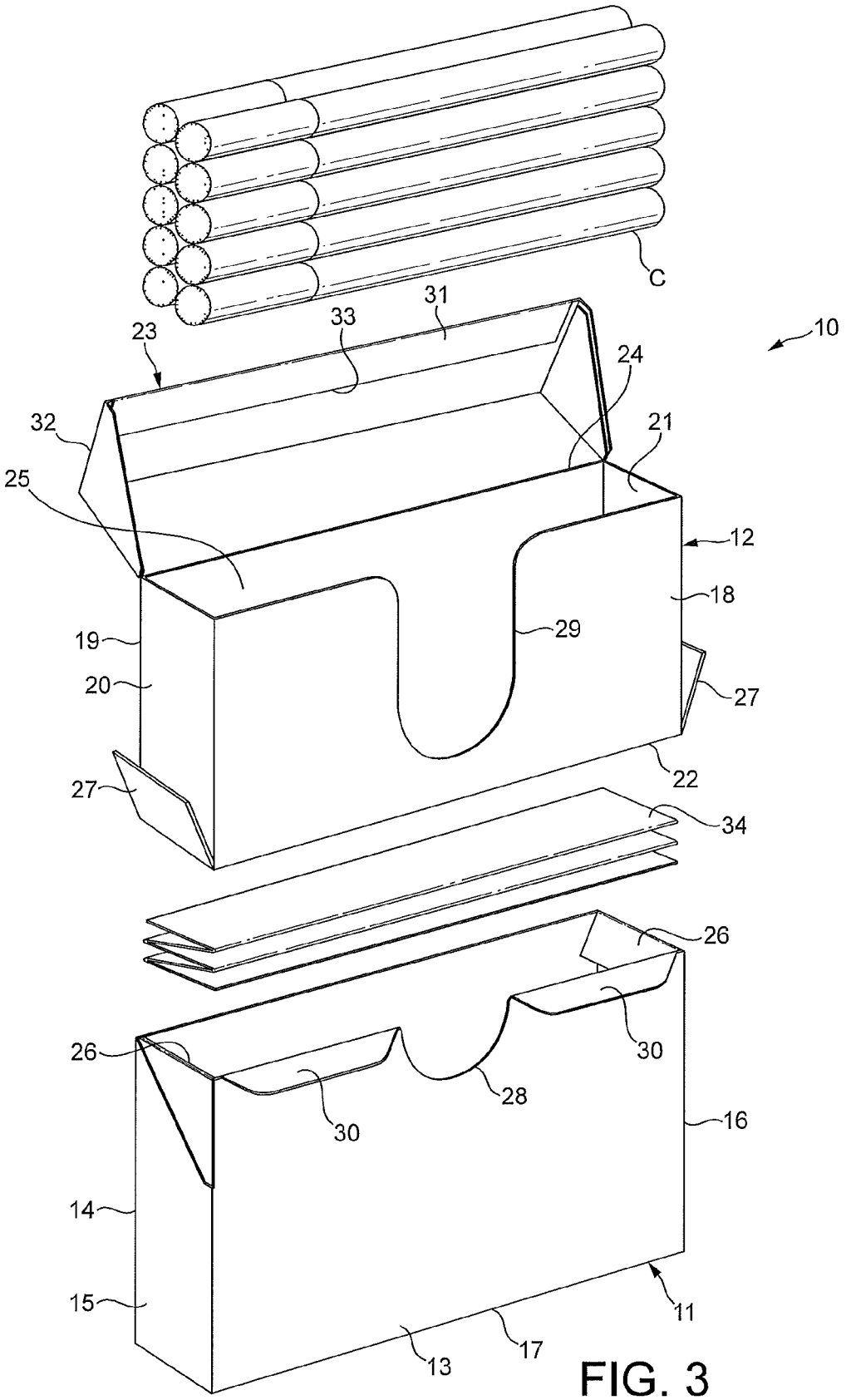
FIG. 3 shows an exploded view of the pack of FIGS. 1 and 2.

Referring to FIGS. 1 to 3, a pack 10 of a first embodiment of the invention is shown comprising an outer housing 11 and an inner casing 12. The outer housing 11 has major front and rear walls 13, 14 connected by minor side walls 15, 16 and a bottom wall 17. The top of the outer housing 11 is open to receive the inner casing 12, which comprises major front and rear walls 18, 19 connected by minor side walls 20, 21 and a bottom wall 22. The inner casing includes a hinged lid 23 which is pivotally connected to the rear wall 19 about a hinge line 24 and which is moveable between a closed position in which an access aperture 25 at the upper portion of the inner casing 12 is covered, and an open position in which the access aperture 25 is exposed for removal of smoking articles C (see FIG. 3) intended to be contained in the inner casing 12.

The inner casing 12 is slidably received in the outer housing 11 and moveable between an open position (see FIG. 2) in which it at least partially projects out of the outer housing 11 and the hinged lid 23 is pivoted open to expose the access aperture 25, and a closed position (see FIG. 1) in which the inner casing 12 is further retracted into the outer housing 11 and the hinged lid 23 is pivoted closed so that the access aperture 25 is concealed to prevent the contents of the inner casing 12 being removed.

The pack 10 includes a stop mechanism to prevent the inner casing 12 extending out of the outer housing 11 beyond a predetermined distance. The stop mechanism comprises a pair of inwardly folded tabs 26 on the inside of the side walls 15, 16 of the outer housing 11, and a pair of corresponding tabs 27 projecting from the side walls 20, 21 of the inner casing 12. The inner casing 12 can be extended out of the outer housing 11 until the tabs 27 on the inner casing 12 engage the tabs 26 on the outer housing 11 and prevent further sliding movement of the inner casing 12 out of the outer housing 11.

A slot 28 is formed in the front wall 13 of the outer housing 11 and a corresponding slot 29 is formed in the front wall 18 of the inner casing 12 aligned with the slot 28 in the outer housing 11.

The pack 10 is provided with a lid-locking mechanism comprising a pair of resilient locking tabs 30 extending downwards and away from the top of the front wall 13 of the outer housing 11, and an inner flap 31 folded over and adhered onto the inside of the front wall 32 of the lid 23, to define a lip 33 at the remote edge of the inner flap 31. In use, when the lid 23 is moved to the fully closed position, the resilient locking tabs 30 ride over the inner flap 31 on the inside of the lid 23 and locate against the lip 33. As the locking tabs 30 are resilient, they exert a force acting away from the front wall 13 of the outer housing 11 further urging them into engagement against the lip 33 and maintaining the lid 23 in the closed position.

The pack 10 further includes a biasing element 34 (see FIG. 3) in the form of a resilient folded card spring which is disposed within the outer housing 11 between the bottom wall 17 thereof and the bottom wall 22 of the inner casing 12. The biasing element 34 may be adhered to the outer housing 11 and/or to the inner casing 12, or alternatively, may be formed integrally with either the outer housing 11 or the inner casing 12 from a single blank, within the scope of the invention. The biasing element 34 serves to bias the inner casing 12 in an opening direction (shown by arrow A in FIG. 2) out of the outer housing 11 once the lid locking mechanism described above has been disengaged and the inner casing 12 is free to move relative to the outer housing 11. The biasing element 34 therefore urges the inner casing 12 out of the outer housing 11 until the stop mechanism described above prevents the inner casing 12 extending further out of the outer housing 11 than the predetermined extension distance.

The pack 10 is configured with a longitudinal direction L and a shorter (at least in the closed position) transverse direction T (see FIG. 1). It can be seen from the Figures that the pack 10 opens in the transverse direction T. The pack 10 is intended to contain elongate smoking articles, such as cigarettes C (see FIG. 3), such that their longitudinal axes are aligned in the longitudinal direction L of the pack 10, and are transverse to the opening direction A of the inner pack 12 relative to the outer housing 11. Also, the pack 10 is configured such that smoking articles C are removable transversely from the inner casing 12 via the access aperture 25, that is, in a direction perpendicular to their longitudinal axes. The aligned slots 28, 29 in the outer housing and inner casing 11, 12 facilitate this removal by acting as thumb/finger slots to enable a user to manipulate smoking articles C from the pack out 10 of the access aperture 25, even when there are only a few remaining smoking articles C remaining in the bottom of the inner casing 12. In the closed position of the pack 10, the front wall 32 of the lid 23 covers the slot 28 in the outer housing 11 and the slot 29 in the inner casing 12 is covered by both the front wall 13 of the outer housing 11 and the front wall 32 of the lid 23. Therefore, in the closed position, the pack 10 is sealed and there is no path from the outside to the inside of the pack 10 via the slots 28, 29.

In use, to open the pack 10, a user pivots open the lid 23, disengaging the resilient locking tabs 30 of the lid locking mechanism from the lip 33 of the inner flap 31 and the biasing element 34 urges the inner casing 12 out of the outer housing 11 in the direction of arrow A until it reaches the maximum predetermined open position defined by the stop mechanism described above. The smoking articles C are then accessible and can be removed transversely from the inner casing 12 by the user through the access aperture 25 as described above. Once the user has extracted a smoking article C, the lid 23 is pivoted to the closed position and the inner casing 12 is pushed back into the outer housing 11 in the opposite direction of arrow A until the resilient locking tabs 30 of the lid locking mechanism engage against the lip 33 of the inner flap 31, holding the pack 10 in the closed position against the force of the biasing element 34.

The biasing element 34 provides a secure locking engagement for the lid locking mechanism because it biases the lip 33 of the lid 23 upwards against the lower edges of the resilient locking tabs 30 and avoids play in the lid 23 in the closed position, which also provides a reassuring tactile sensation of a premium quality feel to the packaging. However, the invention is not intended to be limited to a pack having a biasing element 34 urging the inner casing 12 out of the outer housing 11 and instead, may equally omit any biasing element such that the inner casing 12 is manually moveable into and out of the outer housing 11.

The biasing element 34 shown and described above comprises a folded card element either adhered to or formed integrally with the outer housing 11 and/or inner casing 12. However, it is intended within the scope of the invention that other forms of biasing element could be provided, such as a sponge block, or a resilient plastic element, for example, a folded/curved PET strip.

The configuration of the biasing element 34 of the pack 10 shown and described above is such that it provides a biasing force against the inner casing 12 over the full range of movement from the fully closed position to the maximum fully extended open position as defined by the stop mechanism. However, it is intended within the scope of the invention that the biasing element may alternatively be configured to only exert an opening biasing force on the inner casing 12 over part of the opening movement of the inner casing 12 from the initial fully closed position.

As a further alternative to having a biasing element 34, or the inner casing 12 being manually moveable between the open and closed positions, it is intended within the scope of the invention that the pack 10 may alternatively include a 'push-push' opening and closing mechanism disposed within the outer housing 11 between the bottom wall 17 thereof and the bottom wall 22 of the inner casing 12. Such a mechanism is a self-contained unit comprising a spring element and a releasable latch mechanism operable such that when the inner casing 12 is pushed into the outer housing 11 against the biasing force of the spring element, the latch engages and the inner casing 12 remains in the retracted closed position. Then when the inner casing 12 is pushed into the outer housing 11 again, the latch mechanism disengages and the inner casing 12 extends out of the outer housing 11 under the force of the biasing element to the extended open position. Subsequent pushing of the inner casing 12 into the outer housing 11 causes the latch mechanism to engage again the inner casing 12 remains in the retracted closed position again, so the open/closing process is alternately repeated. In such an embodiment, the lid locking mechanism may be omitted.

The embodiment of the invention shown and described above shows the resilient locking tabs 30 formed on the outer housing 11. However, it is intended within the scope of the invention that the outer housing 11 may include an inner frame between it and the inner casing 12, and such locking tabs may alternatively be formed on such an inner frame.

The embodiments of the invention shown and described above show the tabs 26, 27 of the stop mechanism being provided on the side walls of the outer housing 11 and inner casing 12. However, the stop mechanism tabs may alternatively be provided on the rear and/or front walls of the outer housing 11 and inner casing 12. Furthermore, the stop mechanism on the side or rear walls of the inner casing 12 and outer housing 11 may comprise an alternative configuration to that shown and described above. For example, the mechanism may comprise a flap on the top edge of one or more walls of the outer housing 11 which is folded over onto the inside surface of said wall(s) (and may or may not be adhered thereto), and a stepped notch formed projecting out of the outer surface of the corresponding wall(s) of the inner casing 12 configured to abut the edge of the flap(s) when the inner casing 12 reaches its fully extended open position.

Figure 4:
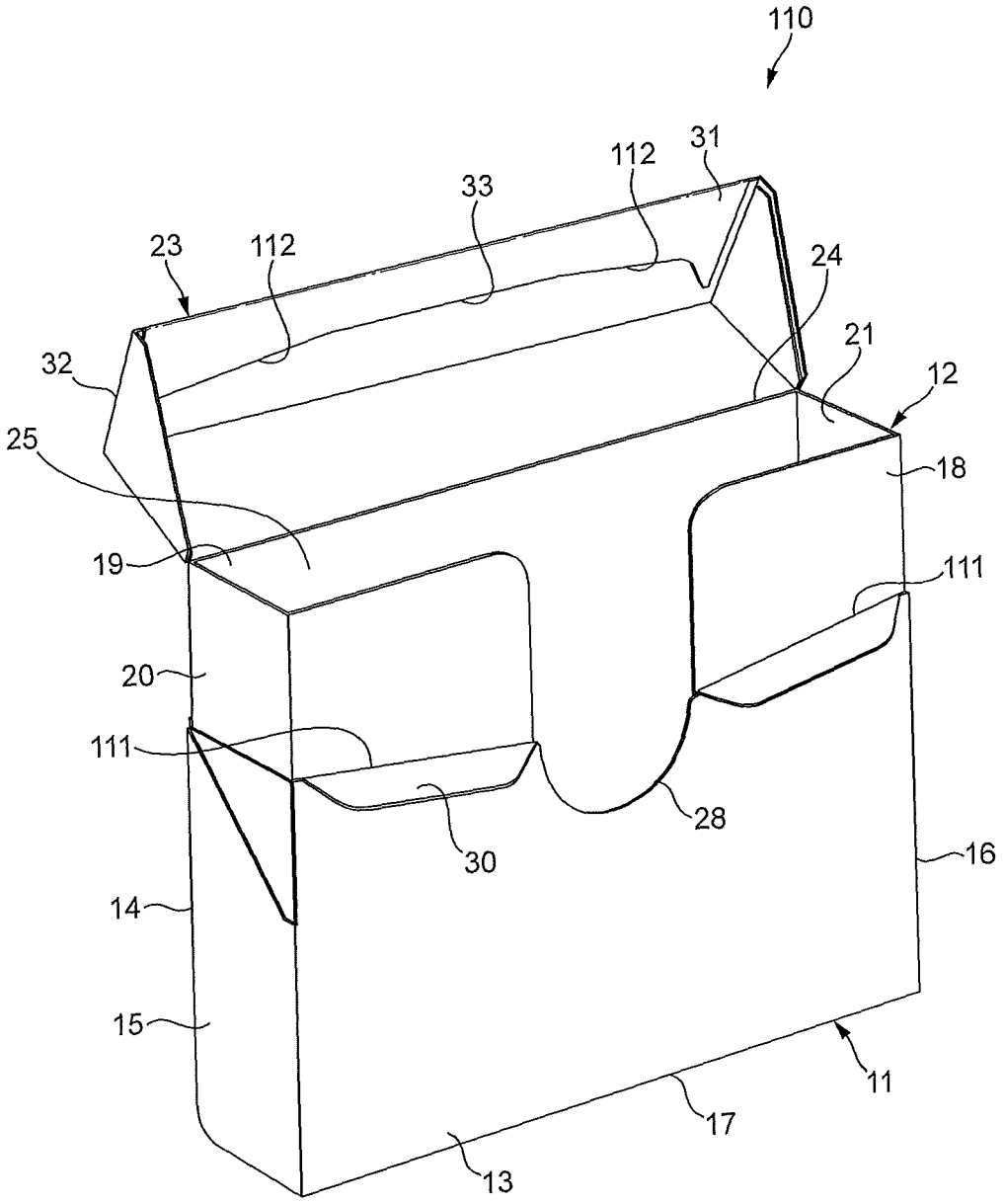
FIG. 4 shows a pack according to a second embodiment of the invention in an open position.

Referring now to FIG. 4, a pack 110 according to a second embodiment of the invention is shown in an open position corresponding to the view of the first embodiment shown in FIG. 2. The pack 110 is largely similar to that of the first embodiment and like features retain the same reference numerals. A difference between the pack 110 of the second embodiment and that of the first is that the top edges 111 of the front wall 13 of the outer housing 11 of the pack 110 of the second embodiment are angled downwards towards the slot 28 in the middle of the front wall 13. The locking tabs 30 of the lid locking mechanism are also correspondingly angled downwards towards the middle of the front wall 13. Also, the lip 33 on the inside of the front wall 32 of the lid 23 includes correspondingly angled portions 112. The locking tabs 30 being angled provides a technical advantage during closing of the pack 110 in that as the lid 23 is pivoted closed, the lid front wall 32 first engages the outer edges of the locking tabs 30 and as the lid 23 is pivoted further closed, the lower edge of the lid front wall 32 continues to engage the locking tabs 30 at a point increasingly further inwards towards the centre of the front wall 13 of the outer housing 11. This creates a smoother closing motion of the pack 110. Furthermore, if the front wall 13 of the outer housing 11 is bowed outwards at all, the lid 23 engaging the outer edges of the locking tabs 30 first draws the middle (i.e. the part outwardly bowed the most) of the front wall 13 of the outer housing 11 inwards to locate within the lid, whereas in a horizontal-edged pack, the lid 23 may simply abut the upper edge of the front wall 13 of the outer housing 11 and foul the closing motion.

Figure 5:
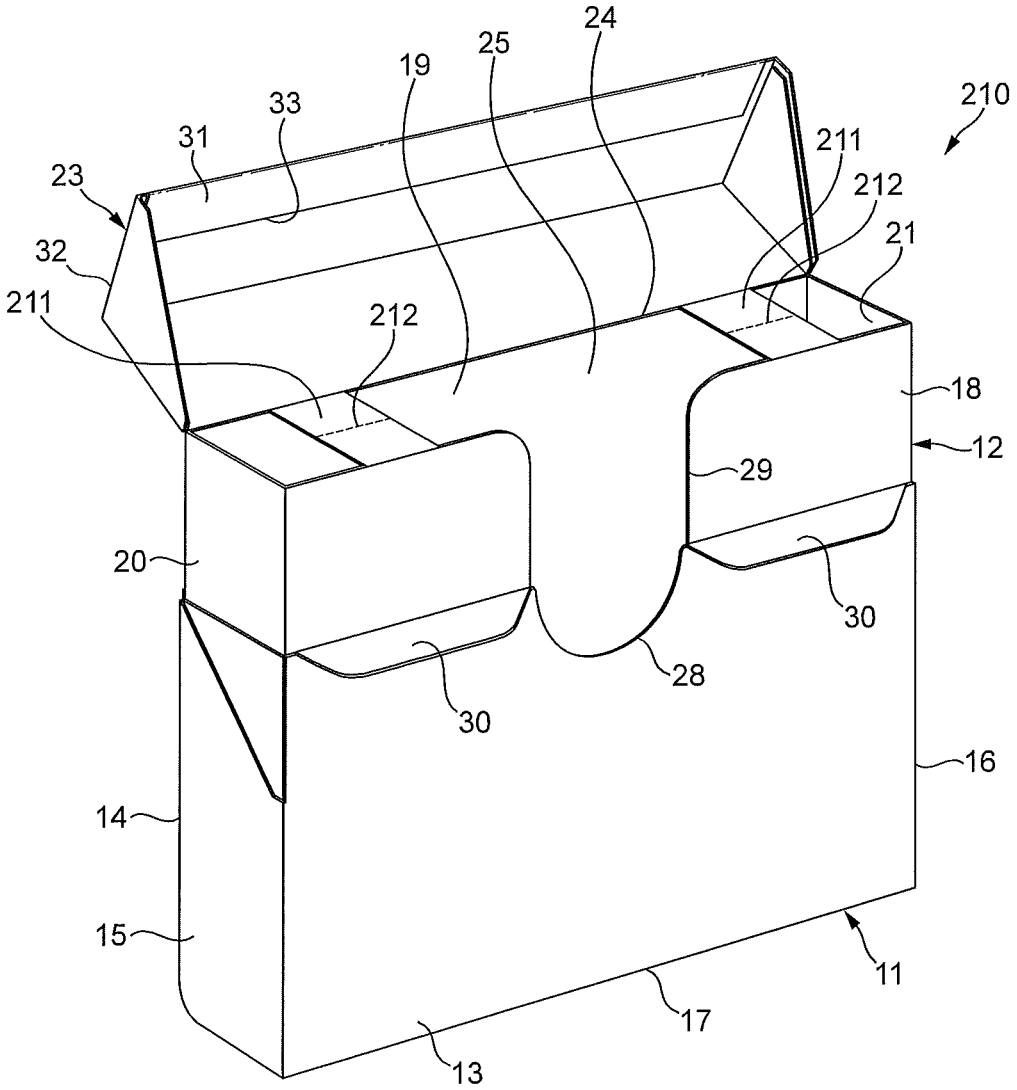
FIG. 5 shows a pack according to a third embodiment of the invention in an open position.

Referring now to FIG. 5, a pack 210 according to a third embodiment of the invention is shown in an open position corresponding to the view of the first and second embodiments shown in FIGS. 2 and 4. The pack 210 is largely similar to that of the first embodiment and like features retain the same reference numerals. A difference between the pack 210 of the third embodiment and that of the first is that the access aperture 25 includes a pair of retaining tabs 211 extending thereacross from the front wall 18 to the rear wall 19 of the inner casing 12. These retaining tabs serve to prevent the smoking articles C contained within the inner casing 12 from freely falling out of the access aperture 25 when the pack is in the open position and the pack 210 is inverted or shaken. This can be of benefit because in conventional packs in which the smoking articles are arranged such that they are longitudinally withdrawn from the pack, the smoking articles contact each other and friction between them helps retain them in the pack (at least when the pack is full or substantially full). Also, the orientation of the smoking articles in such conventional packs generally makes them less prone to falling out. In the pack 210 of the present invention, the smoking articles C are stacked in an opening direction (arrow A) so that there will always be an upper-most smoking article nearest the access aperture 25 which may be more prone to falling out of the inner casing 12. Therefore, the retaining tabs 211 act as a barrier to prevent the uppermost smoking article (and subsequent smoking articles) falling out of the access aperture 25 unintentionally.

The retaining tabs may be resilient tabs formed integrally with either the front wall 18 or rear wall 19 of the inner casing 12 or may be separate elements adhered thereto. Alternatively, the retaining tabs 211 may be formed on both the front and rear walls 18, 19 of the inner casing 12, and may meet in the middle of the access aperture 25. It is further intended within the scope of the invention that the retaining tabs may be formed integrally with one or both of the front and/or rear walls 18, 19 of the inner casing 12 and may include a line of weakening 212 which is broken upon removal of the first smoking article from the inner casing 12. The resilience of the retaining tabs 211 enables them to continue to serve their smoking article-retaining function after breaking along the line of weakening 212 and removal of the first smoking article. The line of weakening 212 may be formed in the retaining tabs 211 proximate either the front or rear walls 18, 19 of the inner casing 12 (as shown in FIG. 5), or may be formed in the retaining tabs 211 at a point between the front and rear walls 18, 19 of the inner casing 12 such that retaining tabs portions 211 remain on both front and rear walls 18, 19 of the inner casing 12 extending partially across the access aperture 25. The line of weakening 212 may be formed in any known manner, such as by scoring, embossing or perforating the material of the retaining tabs 211.

Figure 6:
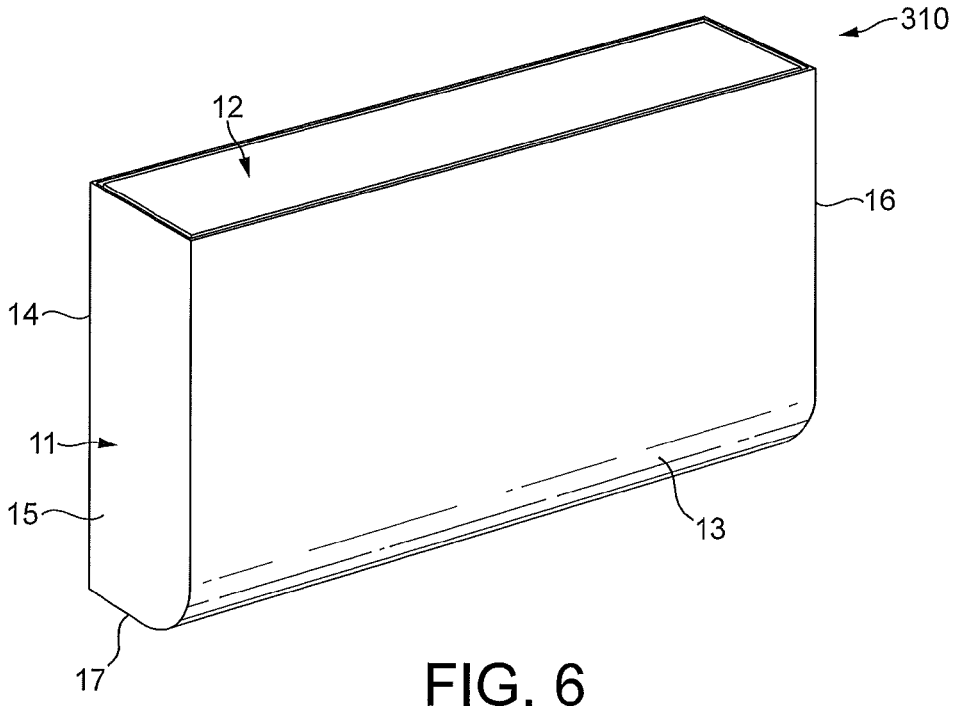
FIG. 6 shows a pack according to a fourth embodiment of the invention in a closed position.
Figure 7:
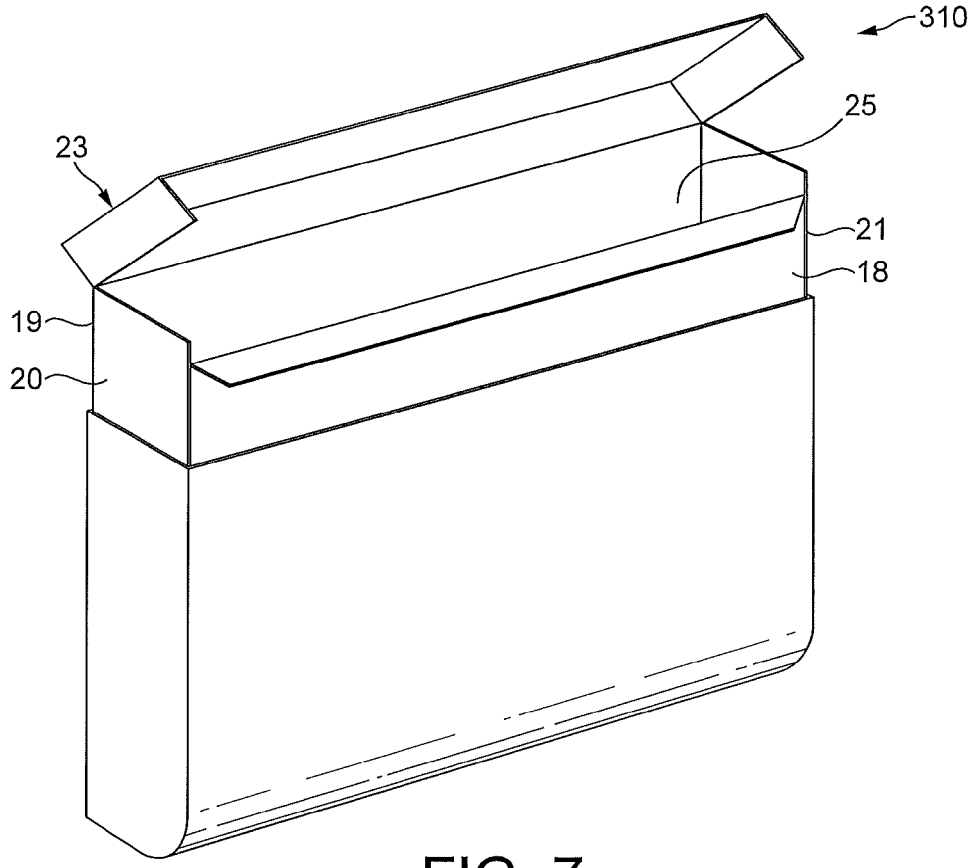
FIG. 7 shows the pack of FIG. 6 in an open position.

A pack 310 according to a fourth embodiment of the invention is shown in FIGS. 6 and 7, and comprises an outer housing 11 and an inner casing 12 similar to the packs of the previously-described embodiments of the invention and like features retain the same reference numerals. A difference between the pack of the fourth embodiment of the invention and the previously-described embodiments is that the hinged lid 23 is configured so that when it is pivoted into the closed position to cover the access aperture 25 of the inner casing 12, the rear and side walls of the lid 23 lie flush with the front, rear and side walls 18, 19, 20, 21 of the inner casing 12. Furthermore, the pack 310 is configured such that, in the closed position (see FIG. 6), the inner casing 12, including the hinged lid 23, is entirely received within the outer housing 11.

The front wall 18 of the inner casing 12 includes a resilient flap 313 which extends towards the rear wall 19 of the inner casing 12 at least partially across the elongate access aperture 25 and thereby serves to prevent smoking articles contained within the inner casing 12 from unintentionally falling out through the access aperture 25 when the pack 310 is inverted or shaken. A user is able to remove smoking articles when desired by folding the flap 313 away from the access aperture. To aid extraction of smoking articles from the pack 310, the front wall 18 of the inner casing 12 may be provided with a slot (not shown) to enable a user to manipulate smoking articles from the bottom of the inner casing 12 towards the access aperture 25. Such a slot may be configured as shown in FIGS. 2-5 in respect of the first to third embodiments of the invention.

The inner casing 12 may be spring-biased out of the outer housing 11 into the open position (see FIG. 7), and a stop mechanism may be provided to prevent the inner casing 12 extending further than a predetermined distance out of the outer housing, as described previously. The pack 310 may also include a latch mechanism to hold the inner casing 12 in the retracted closed position within the outer housing 11 against the force of the biasing means. Such latch mechanism could, for example, comprise projecting tab formed on the outside of the front wall 18 of the inner casing 12, and an inwardly folded flap on the inside of the front wall 13 of the outer housing 11 which forms a step against which the projecting tab would engage in the closed position. The pack could be opened by pressing the side walls 15, 16 of the outer housing 11 together to bow the front wall 13 and disengage the tab from the step to allow the inner casing 12 to extend out of the outer housing 11 under the force of a biasing means. In an alternative arrangement intended within the scope of the invention, the pack 310 could include a "push-push" mechanism between the bottom wall 17 of the outer housing 11 and the bottom wall of the inner casing 12, as described previously.

Figure 8:
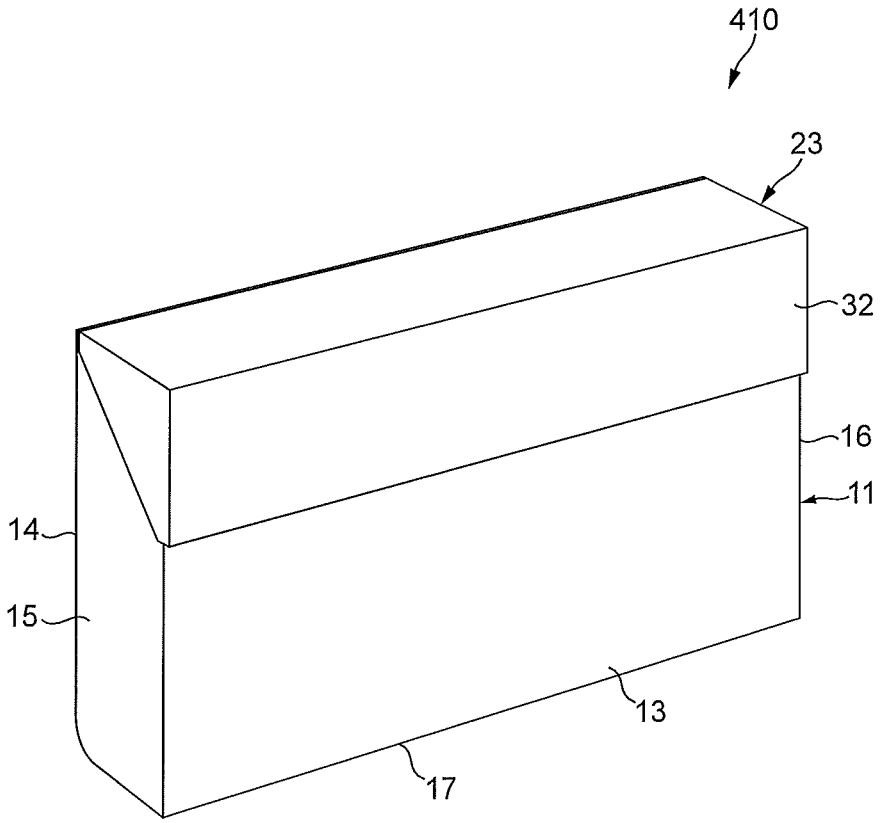
FIG. 8 shows a pack according to a fifth embodiment of the invention in a closed position.
Figure 9:
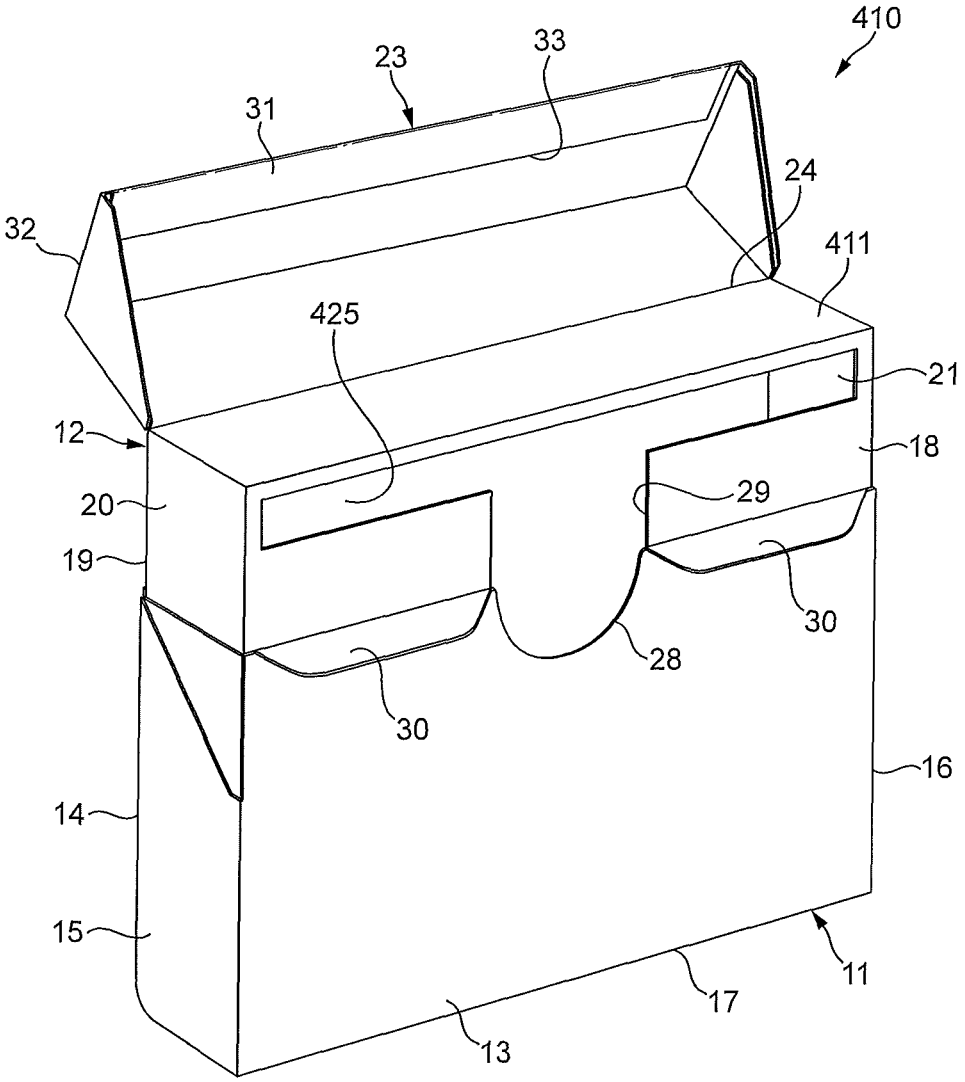
FIG. 9 shows the pack of FIG. 8 in an open position.

A pack 410 according to a fifth embodiment of the invention is shown in FIGS. 8 and 9, and comprises an outer housing 11 and an inner casing 12 similar to the pack of the first embodiment of the invention and so like features retain the same reference numerals and a detailed description thereof will not be repeated. A difference between the pack 410 of the fifth embodiment of the invention and that of the first embodiment is that the inner casing 12 is not open at its upper end but instead includes a top wall 411. Furthermore, the front wall 18 of the inner casing 12 includes an elongate access aperture 425 extending transversely across the top of the front wall 18, for smoking articles contained within the inner casing 12 to be dispensed therefrom. In the closed position (see FIG. 8), the elongate access aperture 425 is concealed within the outer housing 11 and the hinged lid 23 is folded down over the front of the outer housing 11 such that the locking tabs 30 ride over the inner flap 31 on the inside of the lid 23 and locate against the lip 33 holding the lid closed.

To aid extraction of smoking articles from the pack 410, the front wall 18 of the inner casing 12 includes a slot 29 in communication with the elongate access aperture 425 to enable a user to manipulate smoking articles from the bottom of the inner casing 12 towards and out of the access aperture 425, as described previously.

The inner casing 12 may be spring-biased out of the outer housing 11 into the open position (see FIG. 7), and may include a stop mechanism to prevent the inner casing 12 extending further than a predetermined distance out of the outer housing, as described previously. Alternatively, the pack 410 could include a "push-push" mechanism between the bottom wall 17 of the outer housing 11 and the bottom wall of the inner casing 12, as described previously.

Figure 10:
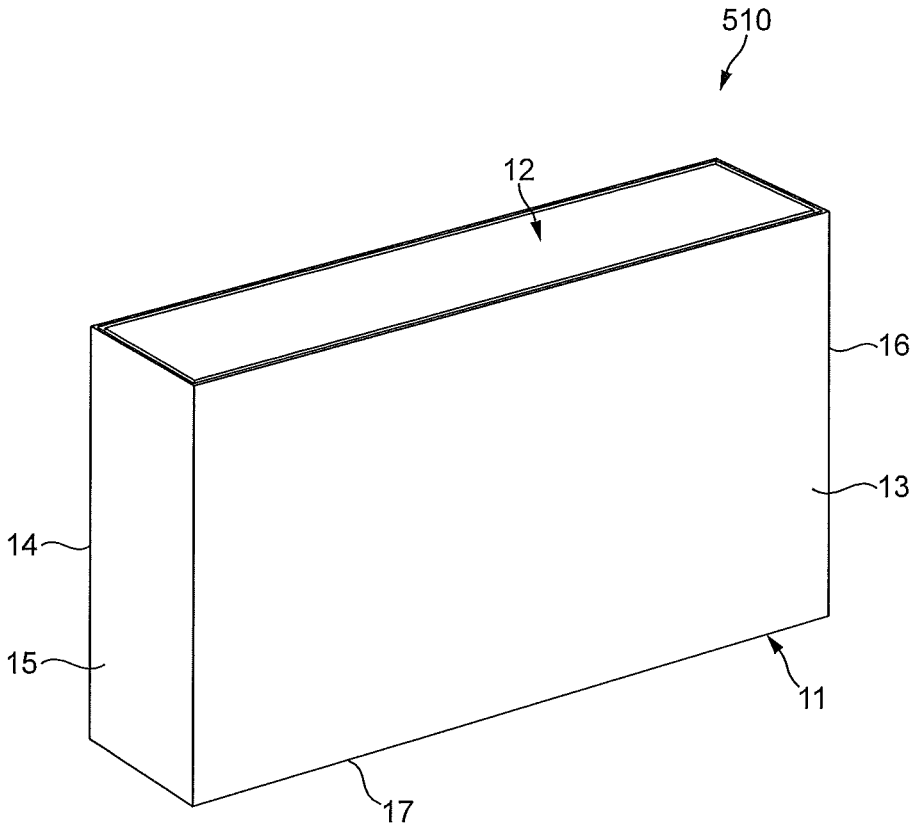
FIG. 10 shows a pack according to a sixth embodiment of the invention in a closed position.
Figure 11:
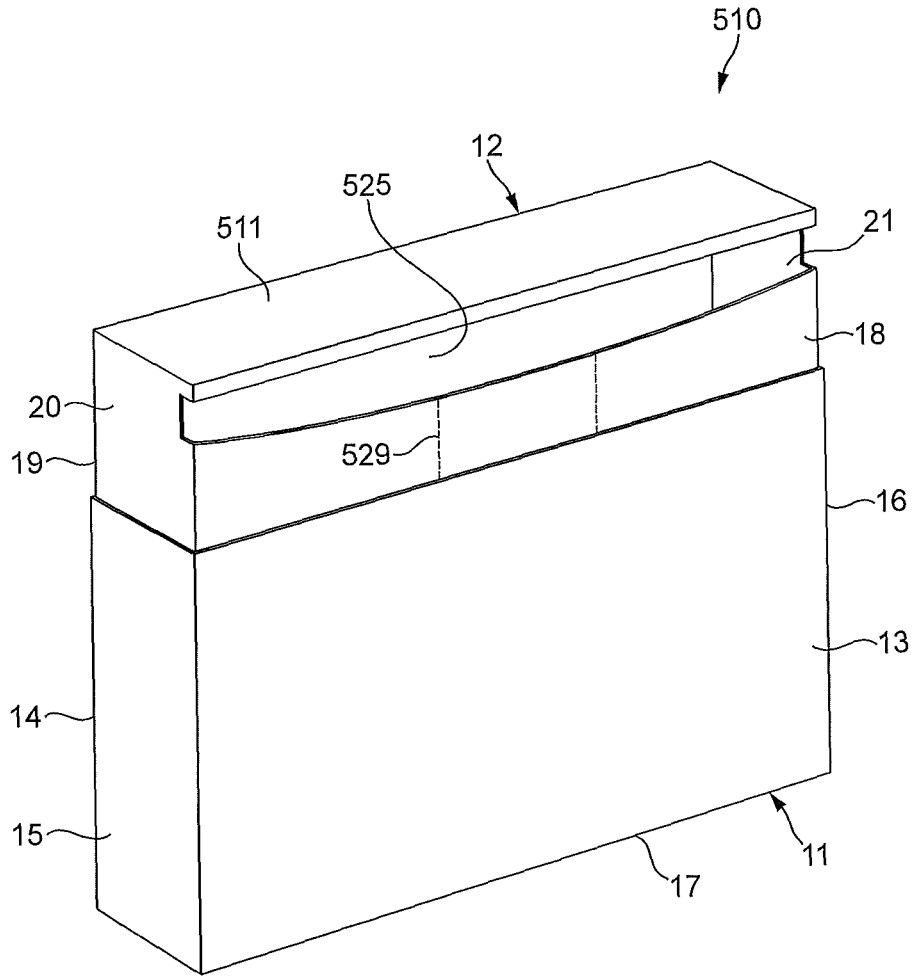
FIG. 11 shows the pack of FIG. 10 in an open position.

A pack 510 according to a sixth embodiment of the invention is shown in FIGS. 10 and 11, and comprises an outer housing 11 and an inner casing 12 similar to the packs of the previously-described embodiments of the invention and like features retain the same reference numerals. A difference between the pack of the sixth embodiment of the invention and the previously-described embodiments is that the pack 510 does not include a hinged lid and the top of the inner casing 12 is not open but comprises a top wall 511. Furthermore, the pack 510 is configured such that, in the closed position (see FIG. 10), the inner casing 12 is entirely received within the outer housing 11.

The front wall 18 of the inner casing 12 includes an elongate access aperture 525 which extends around to the side walls 20, 21 of the inner casing 12. This makes it easier for a user to extract a smoking article in transverse direction thereof out of the access aperture 525. To aid extraction of smoking articles from the pack 510, the front wall 18 of the inner casing 12 may be provided with a slot 529 (shown in dashed lines in FIG. 11) to enable a user to manipulate smoking articles from the bottom of the inner casing 12 towards the access aperture 525.

The inner casing 12 may be spring-biased out of the outer housing 11 into the open position (see FIG. 8), and a stop mechanism may be provided to prevent the inner casing 12 extending further than a predetermined distance out of the outer housing, as described previously. The pack 510 may also include a latch mechanism to hold the inner casing 12 in the retracted closed position within the outer housing 11 against the force of the biasing means, as described previously in respect of the pack 310 of the fourth embodiment of the invention. Alternatively, the pack 510 could include a "push-push" mechanism between the bottom wall 17 of the outer housing 11 and the bottom wall of the inner casing 12, as described previously.

All embodiments of the invention shown and described above comprise an elongate access aperture 25, 425, 525 to enable elongate smoking articles, such as cigarettes, intended to be contained within the packs, to be removed transversely from the packs through the access apertures, that is, in a direction perpendicular to the longitudinal direction of the elongate smoking articles.

All embodiments of the invention may be constructed of folded card. Although not illustrated in any of the figures, it is intended within the scope of the invention that each of the packs shown and described above may be constructed with a detachable panel covering the access aperture, the panel being delimited by a line of weakening such as perforations in the material of the pack, such that upon first opening of the pack, a user can remove the panel by breaking along the line of weakening. This would enable tobacco products within the pack to remain fresher during transport and shelf life, and also provide a tamper-evidence function for the consumer.

It is intended that those packs of the invention shown and described above which comprise biasing means to bias the inner casing into an open position extended out of the outer housing, may alternatively not include any biasing means and may instead require a user to manually withdraw the inner casing out of the outer housing when a smoking article is to be retrieved from the pack. In such embodiments, locking means may not necessarily be provided to secure the pack in the closed position.

Although various embodiments of the invention are shown and described above, the invention is not intended to be limited to these exemplary embodiments and packs including any combination of non-mutually exclusive features described above are intended to fall within the scope of the invention, which is defined by the claims hereafter.

In order to address various issues and advance the art, the entirety of this disclosure shows by way of illustration various embodiments in which the claimed invention(s) may be practiced and provide for superior packs for smoking articles. The advantages and features of the disclosure are of a representative sample of embodiments only, and are not exhaustive and/or exclusive. They are presented only to assist in understanding and teach the claimed principles. It should be understood that they are not representative of all claimed inventions. As such, certain aspects of the disclosure have not been discussed herein. That alternate embodiments may not have been presented for a specific portion of the invention or that further undescribed alternate embodiments may be available for a portion is not to be considered a disclaimer of those alternate embodiments. It will be appreciated that many of those undescribed embodiments incorporate the same principles of the invention and others are equivalent. Thus, it is to be understood that other embodiments may be utilized and modifications may be made without departing from the scope and/or spirit of the disclosure. As such, all examples, implementations, and/or embodiments are deemed to be non-limiting throughout this disclosure. Also, no inference should be drawn regarding those embodiments discussed herein relative to those not discussed herein other than it is as such for purposes of reducing space and repetition. Various embodiments may suitably comprise, consist of, or consist essentially of, various combinations of the disclosed elements, components, features, parts, steps, means, etc. Some of the disclosed features, elements, implementation, etc., may be mutually contradictory, in that they cannot be simultaneously present in a single embodiment. Similarly, some features are applicable to one aspect of the disclosure, and inapplicable to others. In addition, the disclosure includes other inventions not presently claimed. Applicant reserves all rights in those presently unclaimed inventions including the right to claim such inventions, file additional applications, continuations, continuations in part, divisions, and/or the like thereof. As such, it should be understood that advantages, embodiments, examples, function, features, structural, and/or other aspects of the disclosure are not to be considered limitations on the disclosure as defined by the claims or limitations on equivalents to the claims.

The invention claimed is:

1. A pack for smoking articles comprising:

an outer housing including an open end;

an inner casing telescopically received within the outer housing and moveable between an open position in which the inner casing at least partially extends out of the open end of the outer housing, and a closed position in which the inner casing is retracted further into the outer housing than in the open position; and a resilient bias element disposed between the outer housing and the inner casing, the resilient bias element biasing the inner casing toward the open position, the pack having a longitudinal dimension and a transverse dimension that is shorter than the longitudinal dimension when the pack is in the closed position, the inner casing being telescopically slidable relative to the outer housing in a direction of the transverse dimension, the pack configured to contain a plurality of elongate smoking articles such that their longitudinal axes are substantially aligned with the longitudinal dimension, and wherein the inner casing includes an elongate access aperture configured to enable the elongate smoking articles to be dispensed therefrom in a direction transverse to their longitudinal axes.

2. The pack according to claim 1, wherein the inner casing comprises an outer wall that includes a slot configured to allow a user to manipulate smoking articles contained within the inner casing towards and out of the access aperture.

3. The pack according to claim 2, wherein the outer housing comprises an outer wall that includes a slot positioned such that it corresponds with the slot of the inner casing.

4. The pack according to claim 1, further comprising a cooperating lock mechanism configured to retain the inner casing in the closed position within the outer housing.

5. The pack according to claim 1, wherein the inner casing includes a lid hingedly attached thereto and pivotable between an open position, in which the access aperture is exposed, and a closed position, in which the lid covers the access aperture.

6. The pack according to claim 1, further comprising a cooperating lock mechanism configured to retain the inner casing in the closed position within the outer housing, wherein the inner casing includes a hinged lid pivotable between an open position, in which the access aperture is exposed, and a closed position in which the lid covers the access aperture, and wherein the lock mechanism comprises at least one first tab provided on the outer housing and a second tab provided on the lid.

7. The pack according to claim 6, wherein the at least one first tab is angled downwards towards the middle of a corresponding wall of the outer housing.

8. The pack according to claim 1, wherein the inner casing comprises a smoking article retainer configured to prevent smoking articles within the inner casing from freely falling out through the access aperture.

9. The pack according to claim 8, wherein the smoking article retainer comprises at least one resilient tab extending at least partially across the access aperture.

10. The pack according to claim 1, further comprising a stop mechanism configured to prevent the inner casing from extending out of the outer housing beyond a predetermined distance corresponding to a fully open position.

11. The pack according to claim 1, wherein one or more of the following is present:

the inner casing is entirely received within the outer housing when the pack is in the closed position;

the inner casing includes a plurality of walls and the inner casing is telescopically moveable between the open position and the closed position without deformation of the plurality of walls; and the resilient bias element is disposed between a bottom wall of the outer housing and a bottom wall of the inner casing.

12. The pack according to claim 1, further comprising a detachable panel covering the access aperture.

13. The pack according to claim 1, further comprising a plurality of elongate smoking articles positioned such that their longitudinal axes are substantially parallel to a longitudinal direction of the access aperture.

* * * * *